US006994624B2

(12) United States Patent
Gold et al.

(10) Patent No.: US 6,994,624 B2
(45) Date of Patent: Feb. 7, 2006

(54) POKER-TYPE GAME AND METHOD

(76) Inventors: Steven Terrance Gold, 2316 Plaza del Prado, Las Vegas, NV (US) 89102; Jeremy Wood Zarowitz, 1749 Mexican Poppy St., Las Vegas, NV (US) 89128

( * ) Notice: Subject to any disclaimer, the term of this patent is extended or adjusted under 35 U.S.C. 154(b) by 519 days.

(21) Appl. No.: 10/224,861

(22) Filed: Aug. 19, 2002

(65) Prior Publication Data

US 2004/0033830 A1 Feb. 19, 2004

(51) Int. Cl.
*A63F 13/00* (2006.01)
*G06F 17/00* (2006.01)

(52) U.S. Cl. ..... 463/12; 273/292

(58) Field of Classification Search ..... 463/11–13, 463/16, 20, 21, 22; 273/292, 138.1, 139, 273/303

See application file for complete search history.

(56) References Cited

U.S. PATENT DOCUMENTS

| | | | | |
|---|---|---|---|---|
| 5,785,593 | A * | 7/1998 | Wood et al. | 463/13 |
| 5,851,011 | A * | 12/1998 | Lott | 273/292 |
| 5,882,259 | A * | 3/1999 | Holmes et al. | 463/13 |
| 6,345,007 | B1 * | 2/2002 | Kim | 365/207 |
| 6,565,432 | B2 * | 5/2003 | Moody | 463/13 |

* cited by examiner

*Primary Examiner*—Chanda L. Harris
*Assistant Examiner*—Alex F. R. P. Rada, II
(74) *Attorney, Agent, or Firm*—Harry M. Weiss; Craig Weiss; Weiss, Moy & Harris, P.C.

(57) ABSTRACT

A poker-style game and method in which a player who is one card away from achieving a royal flush, following receipt of a first set of replacement cards, is provided the option to receive an additional card for no additional wager. In one embodiment, a player receives a payout even if the additional card does not yield a royal flush. In another embodiment, a player receives a payout if the additional card does not yield a royal flush, but one of the player's prior hands was a winning hand. In still another embodiment, a player receives a payout if the player's final hand is a winning, non-royal flush hand.

18 Claims, 2 Drawing Sheets

POKER-TYPE GAME AND METHOD

FIELD OF THE INVENTION

This invention relates generally to poker-type games and methods, and more particularly to a poker-type game and method that provides an enhanced opportunity for a player to achieve a royal flush.

BACKGROUND OF THE INVENTION

The game of poker is widely played in a casino setting. It is played both in a traditional format, with traditional playing cards, and in an electronic format. In the electronic version, typically known as "video poker," a player makes a wager and is presented with five cards. A player can choose to discard a specified number of cards and receive replacement cards. Whether or not the player's final hand qualifies for a payment is determined according to a pay table, which is generally displayed on the video poker machine itself.

The best hand that a player can achieve in classic five card poker of the type typically played on video poker machines is a royal flush. A royal flush consists of an Ace-high straight, where all of the cards have the same suit. The payout for a royal flush can be quite significant, and indeed potentially life-altering.

On the other hand, sophisticated players realize that the odds of achieving a royal flush hand can be extremely remote. Thus, a player may be reluctant to break up a winning hand (for example, having a straight or two of a kind) in an effort to achieve a royal flush. Or, where a game requires placement of an additional wager to obtain a second chance at a better hand, sophisticated players may resist this temptation, again recognizing just how difficult it is to achieve a royal flush. This reluctance can dampen player excitement.

A need therefore existed for a poker-style game and method that provides a player with an opportunity at a royal flush, after replacement cards have been drawn, without the need place an additional wager. Preferably, the game and method should reward a player for achieving a winning hand on either the initial or replacement hands, in the event that the third hand does not result in a royal flush. Still further, it would also be preferred for the game and method to reward a player for coming within one card of a royal flush on either the first or second hand. Yet further, it would be preferred for the game to reward a player for coming within one card of a royal flush, and at the same time having a predetermined winning hand. And it would be preferred for the game to allow a player to purchase royal flush insurance at the time of the making of the initial wager, to qualify for the right to receive a second replacement card draw if the player is one card away from a royal flush.

The present game satisfies these needs and provides other, related, advantages.

SUMMARY OF THE INVENTION

It is an object of the present invention to provide a poker-style game and method that provides a player with an opportunity at a royal flush, after replacement cards have been drawn, without the need place an additional wager.

It is a further object of the present invention to provide a poker-style game and method that rewards a player for achieving a winning hand on either the initial or replacement hands, in the event that a third hand does not result in a royal flush.

It is a still further object of the present invention to provide a poker-style game and method that rewards a player for coming within one card of a royal flush on either the first or second hand.

It is a yet further object of the present invention to provide a poker-style game and method that rewards a player for coming within one card of a royal flush, and at the same time having a predetermined winning hand.

It is a further object of the present invention to provide a poker-style game and method that allows a player to purchase royal flush insurance at the time of the making of the initial wager, to qualify for the right to receive a second replacement card draw if the player is one card away from a royal flush.

Other objects, features and advantages of the present invention will become apparent from a consideration of the following detailed description.

BRIEF DESCRIPTION OF THE PREFERRED EMBODIMENTS

In accordance with one embodiment of the present invention, a poker-style game is disclosed. The game comprises, in combination: a video display adapted to display to a player five playing cards for a poker-style game; means for permitting a player to hold a desired number of said five playing cards; means for permitting said player to receive replacement cards for each of said five playing cards that said player elects not to hold; means for prompting said player that said player is only one card away from achieving a royal flush; and means for providing said player with an option to receive one additional replacement card.

In accordance with another embodiment of the present invention, a method for playing a poker-style game is disclosed. The method comprises the steps of: providing a video display adapted to display to a player five playing cards for a poker-style game; displaying said five playing cards to said player on said video display; permitting a player to hold a desired number of said five playing cards; permitting said player to receive replacement cards for each of said five playing cards that said player elects not to hold; prompting said player that said player is only one card away from achieving a royal flush; and providing said player with an option to receive one additional replacement card.

In accordance with still another embodiment of the present invention, a method for playing a poker-style game is disclosed. The method comprises the steps of: providing a video display adapted to display to a player five playing cards for a poker-style game; displaying said five playing cards to said player on said video display; permitting a player to hold a desired number of said five playing cards; permitting said player to receive replacement cards for each of said five playing cards that said player elects not to hold; prompting said player that said player is only one card away from achieving a royal flush; providing said player with an option to receive one additional replacement card; said player exercising said option to receive said one additional card; awarding a payout to said player if, after receiving said one additional card, said player has achieved a royal flush; awarding a payout to said player if, after receiving said one additional card, said player has not achieved a royal flush; awarding a payout to said player if, after receiving said one additional card, said player has not achieved a royal flush, provided said player had achieved a winning hand prior to receiving said one additional card; and awarding a payout to said player if, after receiving said one additional card, said player has not achieved a royal flush, provided said player has achieved a winning hand after receiving said one additional card.

DETAILED DESCRIPTION OF THE PREFERRED EMBODIMENTS

Figure 1:
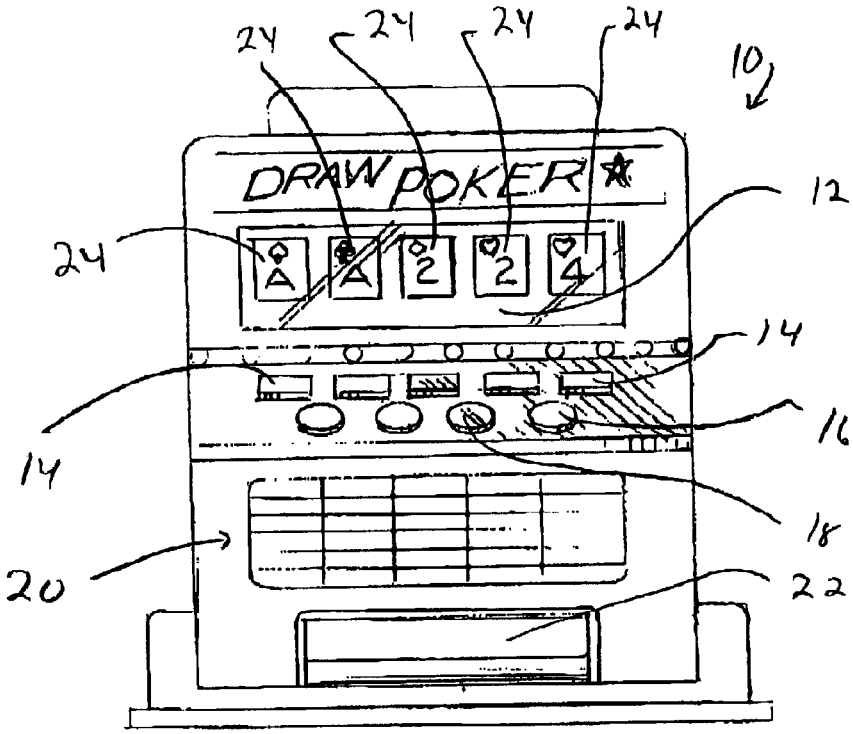
FIG. 1 is a front view of a video poker terminal.

Referring first to FIG. 1, a video poker terminal 10 is shown. Its main features include a video display 12 (see also FIG. 2), five hold buttons 14, a draw/deal button 16, at least one bet button 18, a pay table 20, and a coin output 22. The terminal 10 should also have a payment receiver (not shown), through which coins, cash, payment cards, or the like may be inserted for purposes of placing a wager.

Generally, in a prior art poker game, play is initiated by the insertion of a payment into the payment receiver. A player will typically then depress the bet button 18 in order to receive a display of a hand of cards. (In some games, more than one bet button 18 is provide, with for example one bet button allowing a player to bet one amount, and another allowing a player to bet a larger amount.) After a hand of cards is displayed in the video display 12, the player then decides which he or she wants to hold and which to discard. A player indicates a hold selection for each card that is to be held by depressing the hold button 14 located directly below a card 24 that is to be held. (If a player changes his or her mind, the hold button 14 can be depressed a second time to cancel the selection.)

Once the player completes his or her hold selections, the player will depress the draw/deal button 16 a second time. This will cause the non-held cards 24 to be replaced with new cards. If the player has a winning hand according to the pay table 20, a payment is made through the coin output 22.

Figure 2:
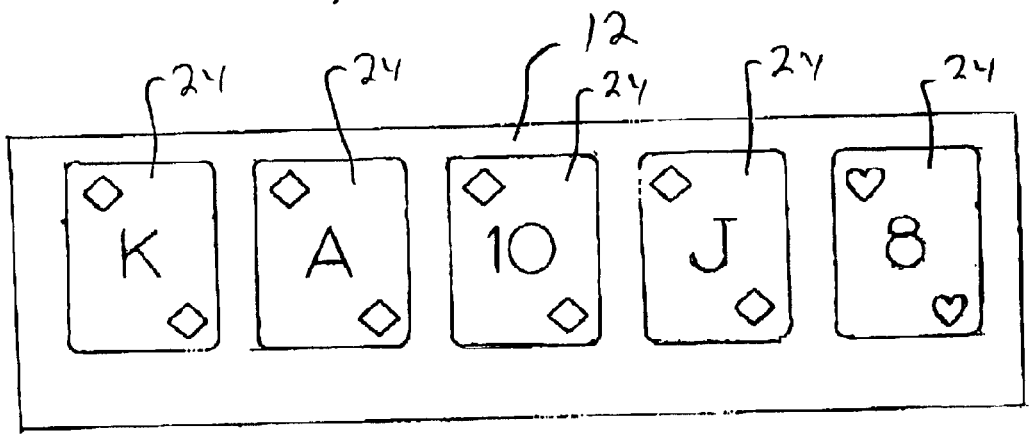
FIG. 2 is a front view of a video poker screen, showing a poker hand that is one card away from a royal flush.

Referring now to FIG. 2, the situation is presented where a player has a five card hand that is only one card (the Queen of Diamonds) away from achieving a royal flush. The game and method of the present invention addresses this type of situation.

Figure 3:
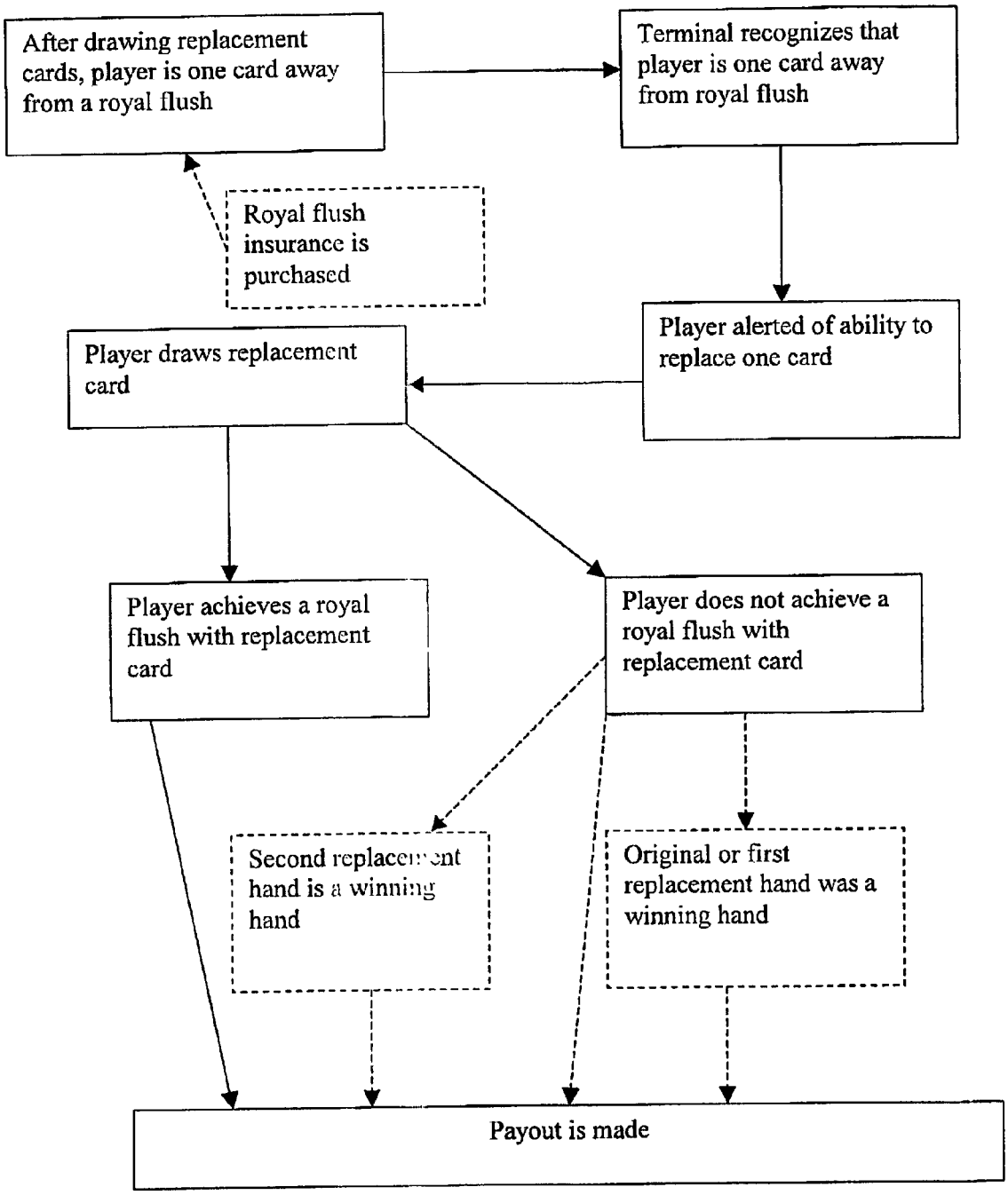
FIG. 3 is a flow chart depicting a number of methods of play of the present invention.

Referring now to FIG. 3, a method of an embodiment of the game of the present invention is illustrated. Where a player, after drawing replacement cards, is one card away from a royal flush, software in the terminal 10 will recognize that this situation is presented. It will then prompt the player, to alert him or her of the ability to discard the card 24 that does not fit into a potential royal flush combination. (Using FIG. 2 as an example, the card 24 that the player would wish to discard is the Eight of Hearts.) Such prompting can be in any desired form, including for example by lighting the hold button 14 corresponding to the non-fitting card 24.

If the player wants a replacement card, he or she will not depress the lit hold button 14, and will instead depress the draw/deal button 16. This will cause display of a replacement card, and possibly the achievement of a royal flush hand. No additional wager should be requested from the player.

Still referring to FIG. 3, a method of play of another embodiment of the game of the present invention is illustrated. There is a concern that a player who has a winning combination on either the original or first replacement hand (e.g., a straight, a pair of Aces, etc.) might not want to surrender such a hand to pursue the relatively long-shot of achieving a royal flush. To address this, optionally, a player can be paid an award if he or she had a winning combination on either the original or first replacement hand, in the event that a third hand does not result in a royal flush. That this step is optional is reflected by the use of dashed lines for this portion of the flow chart of FIG. 3.

As an additional option, also illustrated by dashed lines, a payout can be made to a player who has achieved four cards to a royal flush. This would have the effect of encouraging players, from the inception of the game, to play for a royal flush.

As yet another option, also illustrated by dashed lines, a player who elects to receive a second draw for a chance at a royal flush, but who fails to draw the desired card, can receive a payout for achieving a specified winning hand after the second draw. For example, it can be provided that a payout will be made for achieving a pair of Jacks, or better, in the second replacement hand. Again, this rewards a player's risk taking behavior, and increases player excitement.

As a further option, again illustrated by dashed lines, a player can be required to purchase royal flush insurance before the inception of play, by making an additional wager or payment at the beginning of the game. The purpose of such payment would be to secure to the player the later right to a second draw, in the event that a player has four cards to a royal flush.

While the invention has been illustrated with respect to several specific embodiments thereof, these embodiments should be considered as illustrative rather than limiting. Various modifications and additions may be made and will be apparent to those skilled in the art. Accordingly, the invention should not be limited by the foregoing description, but rather should be defined only by the following claims.

We claim:

1. A poker-style game comprising:

a video display adapted to display to a player five playing cards for a poker-style game from 52 playing cards;

means for permitting a player to hold a desired number of said five playing cards, means for permitting said player to receive initial replacement cards for each of said five playing cards that said player elects not to hold from 47 remaining playing cards;

means for prompting said player that said player is only one card away from achieving a royal flush; and means for providing said player with an option to receive only one additional replacement card from all playing cards that were not previously held after receiving at least one of the initial replacement cards and only to try to obtain a missing playing card that when combined with four held playing cards after receiving the at least one of the initial replacement cards that would, if received, give the player a royal flush.

2. The poker-style game of claim 1 further comprising means for permitting said player to make a payment, prior to said display of said five playing cards, to obtain a right to later receive said additional replacement card in the event that said player is only one card away from achieving a royal flush.

3. The poker-style game of claim 1 further comprising means for awarding a payout to said player if, after receiving said one additional replacement card, said player has achieved a royal flush.

4. The poker-style game of claim 1 further comprising means for awarding a payout to said player if, after receiving said one additional replacement card, said player has not achieved a royal flush.

5. The poker-style game of claim 1 further comprising means for awarding a payout to said player if, after receiving said one additional replacement card, said player has not achieved a royal flush, provided said player had achieved a winning hand prior to receiving said one additional replacement card.

6. The poker-style game of claim 1 further comprising means for awarding a payout to said player, if after receiving said one additional replacement card, said player has not achieved a royal flush, provided said player has achieved a winning hand after receiving said one additional replacement card.

7. The poker-style game of claim 6 wherein said winning hand after receiving said one additional replacement card is equal to or better than a pair of Jacks.

8. A method for playing a poker-style game comprising the steps of:

providing a video display adapted to display to a player five playing cards for a poker-style game from 52 playing cards;

displaying said five playing cards to said player on said video display;

permitting a player to hold a desired number of said five playing cards;

permitting said player to receive initial replacement cards for each of said five playing cards that said player elects not to hold from 47 remaining playing cards;

prompting said player that said player is only one card away from achieving a royal flush, and providing said player with an option to receive only one additional replacement card from all playing cards that were not previously held after receiving at least one of the initial replacement cards and only to try to obtain a missing playing card that when combine with four held playing cards after receiving the at least one of the initial replacement cards that would, if received, give the player a royal flush.

9. The method of claim 8, further comprising the step of said player exercising said option to receive said one additional replacement card.

10. The method of claim 9, further comprising the step of awarding a payout to said player if, after receiving said one additional replacement card, said player has achieved a royal flush.

11. The method of claim 9, further comprising the step of awarding a payout to said player if, after receiving said one additional replacement card, said player has not achieved a royal flush.

12. The method of claim 9, further comprising the step of awarding a payout to said player if, after receiving said one additional replacement card, said player has not achieved a royal flush, provided said player had achieved a winning hand prior to receiving said one additional replacement card.

13. The method of claim 9, further comprising the step of awarding a payout to said player if, after receiving said one additional replacement card, said player has not achieved a royal flush, provided said player has achieved a winning hand after receiving said one additional replacement card.

14. The method of claim 13 wherein said winning hand after receiving said one additional replacement card is equal to or better than a pair of Jacks.

15. The method of claim 8 further comprising the step of permitting said player to make a payment, prior to said display of said five playing cards, to obtain a right to later receive said additional replacement card in the event that said player is only one card away from achieving a royal flush.

16. A method for playing a poker-style game comprising the steps of:

providing a video display adapted to display to a player five playing cards for a poker-style game from a deck of playing cards;

displaying said five playing cards to said player on said video display;

permitting a player to hold a desired number of said five playing cards;

permitting said player to receive initial replacement cards for each of said five playing cards that said player elects not to hold from the remaining playing cards;

prompting said player that said player is only one card away from achieving a royal flush;

providing said player with an option to receive only one additional replacement card from all playing cards that were not previously held after receiving at least one of the initial replacement cards and only to try to obtain a missing playing card that when combined with four held playing cards after receiving the at least one of the initial replacement card that would, if received, give the player a royal flush;

said player exercising said option to receive said one additional replacement card;

awarding a payout to said player if, after receiving said one additional replacement card, said player has achieved a royal flush;

awarding a payout to said player if, after receiving said one additional replacement card, said player has not achieved a royal flush;

awarding a payout to said player if, after receiving said one additional replacement card, said player has not achieved a royal flush, provided said player had achieved a winning hand prior to receiving said one additional replacement card; and awarding a payout to said player if, after receiving said one additional replacement card, said player has not achieved a royal flush, provided said player has achieved a winning hand after receiving said one additional replacement card.

17. The method of claim 16 wherein said winning hand after receiving said one additional replacement card is equal to or better than a pair of Jacks.

18. The method of claim 16 further comprising the step of permitting said player to make a payment,

* * * * *

UNITED STATES PATENT AND TRADEMARK OFFICE

CERTIFICATE OF CORRECTION

PATENT NO. : 6,994,624 B2
APPLICATION NO. : 10/224861
DATED : February 7, 2006
INVENTOR(S) : Steven Terrance Gold and Jeremy Wood Zarowitz It is certified that error appears in the above-identified patent and that said Letters Patent is hereby corrected as shown below:

Col. 6, line 58, - Claim 18, at end of Claim 18 add the following: prior to said display of said five playing cards, to obtain a right to later receive an additional replacement card in the event that said player is only one card away from achieving a royal flush.

Signed and Sealed this

First Day of August, 2006

JON W. DUDAS
*Director of the United States Patent and Trademark Office*

UNITED STATES PATENT AND TRADEMARK OFFICE

CERTIFICATE OF CORRECTION

PATENT NO. : 6,994,624 B2
APPLICATION NO. : 10/224861
DATED : February 7, 2006
INVENTOR(S) : Steven Terrance Gold and Jeremy Wood Zarowitz It is certified that error appears in the above-identified patent and that said Letters Patent is hereby corrected as shown below:

Col. 6, line 57, after payment, insert the following: prior to said display of said five playing cards, to obtain a right to later receive an additional replacement card in the event that said player is only one card away from achieving a royal flush.

Signed and Sealed this

Fifth Day of September, 2006

JON W. DUDAS
*Director of the United States Patent and Trademark Office*